United States Patent [19]

Lamaze et al.

[11] Patent Number: 5,013,413

[45] Date of Patent: May 7, 1991

[54] APPARATUS FOR THE CONTINUOUS PRODUCTION OF A POLYVALENT METAL

[75] Inventors: Airy-Pierre Lamaze, Grenoble; Patrick Paillere, Ugine, both of France

[73] Assignee: Compagnie Europeenne du Zirconium Cezus of Tour Manhattan, Courbevoie, France

[21] Appl. No.: 509,131

[22] Filed: Apr. 16, 1990

[30] Foreign Application Priority Data

Apr. 21, 1989 [FR] France ..... 89 06134

[51] Int. Cl.[5] ..... C25C 3/00; C25C 3/26; C25C 7/00

[52] U.S. Cl. ..... 204/64 R; 204/64 T; 204/244; 204/245

[58] Field of Search ..... 204/243 R, 244, 245, 204/246, 242, 64 R, 64 T, 601.5

[56] References Cited

U.S. PATENT DOCUMENTS 4,338,177 7/1982 Withers et al. ..... 204/245
4,521,281 6/1985 Kodija ..... 204/246

*Primary Examiner*—John F. Niebling

*Assistant Examiner*—Kathryn Gorgos

*Attorney, Agent, or Firm*—Dennison, Meserole, Pollack & Scheiner

[57] ABSTRACT

The invention relates to an apparatus for the continuous production of a polyvalent metal by electrolysis of a halide of the metal in a bath of at least one melted salt. The apparatus comprises an electrodismutation cell and a prereduction cell in a contiguous configuration sharing a common wall in the form of a grid which is electrically insulated from the cell walls. The electrodismutation cell includes at least one deposition cathode and at least two anodes which are connected to an at least partly direct current. The prereduction cell includes at least one anode and a cathode constituted by the grid, the anode and cathode being separated by a diaphragm and connected to an at least partly direct current power supply. Means are provided to cause bath flow by forced convection through the grid to produce a top-to-bottom movement in the electrodismutation cell and a bottom-to-top movement in the prereduction cell. Current densities are selected such that free metal is deposited in the electrodismutation cell without generation of halogen, while halogen is generated in the prereduction cell without production of free metal.

4 Claims, 1 Drawing Sheet

APPARATUS FOR THE CONTINUOUS PRODUCTION OF A POLYVALENT METAL

BACKGROUND OF THE INVENTION

1. Field of the Invention

The present invention relates to an apparatus for the continuous production of a polyvalent metal by electrolysis of a halide of said metal dissolved in a bath of at least one melted salt.

2. Description of Related Art

The term polyvalent is here understood to refer to any metal, whose halide is likely to have when dissolved in a bath of melted salts several stable valency states. It can e.g. be titanium, zirconium, niobium, uranium, hafnium, vanadium, tantalum or rare earth metals.

The Expert knows that it is possible to bring about the deposition of a metal by introducing one of its derivatives, such as e.g. a halide, into a bath of melted salts and subjecting it in its simplest form to the action of two electrodes connected to the poles of a direct current source, the halogen being released at the anode and the metal deposited at the cathode. This fusion electrolysis procedure has undergone a large amount of research leading to the development of several processes, which differ as regards the bath composition, the halide concentration of the bath, the physical and chemical state of the halide used, the current density values applied to the electrodes and the production of numerous models of apparatuses differing as a result of their structure and shape, particularly with respect to the electrodes, the halide injection systems and the deposited metal recovery systems.

Most of the presently known apparatuses have a single cell and operate with chloride release at the anode, which makes it possible to place a porous metal diaphragm between the anode and the cathode so as to ensure that the halogen given off does not reoxidize the products resulting from the reduction of the halide by the current and in particular the metal which can be attacked and then forms a heterogeneous deposit liable to contain bath inclusions.

In a certain number of apparatus, the introduction of the halide into the cell takes place via complicated dissolving means and/or means which are difficult to use industrially.

In other apparatuses, the operating conditions are such that the bath is completely saturated with an intermediate valency halide. It is then necessary to use complex stirring systems and to strictly control the temperature in order to prevent any precipitation or spontaneous dismutation of the halide. In addition, certain reduced halides decompose with the formation of sludge, so that the cell has to be periodically stopped for cleaning purposes.

Thus, for example, during the production of titanium by electrolysis, if the metal has a valency equal to or above 2.3 in the halide, the metal deposit becomes spongy and very fine. However, if the said valency is equal to or below 2 and the metal has a weight concentration in the bath equal to or above 5%, sludge formation occurs.

This example shows that it is necessary for the purpose of obtaining a good quality metal under correct cell operating conditions, to very precisely regulate the valency of the metal dissolved in the bath, together with its concentration. However, this could only be obtained, accompanied by other conditions, through the introduction into the cell of a regular halide flow, linked with the deposition rate, in order to maintain the desired concentration, the application to the electrodes of electrical conditions such that they permit an equilibrium of the valency degrees, an appropriate polarization of the diaphragm so as to prevent any metal deposits leading to a clogging or also any attack or action which would lead to perforations or disturbances of the valency state due to the halogen escaping into the cathode compartment.

On an industrial scale, it is very difficult to satisfy these conditions. A large number of scientists have attempted to overcome the problems involved. Thus, e.g., British Patent No. 1 579 955 claims a process for the electrolytic deposition in particular of titanium in an alkaline earth and alkali metal chloride bath, where use is made of a single cell, where:

(a) use is made of a first and a second cathode and an anode;

(b) a salt of the metal at a higher valency is introduced;

(c) the salt is electrolytically reduced to a lower valency on the first cathode;

(d) a mechanical displacement takes place of the lower valency salt from the first cathode, and it is dispersed in the bath;

(e) the metal is electrolytically deposited on the second cathode; stage (c) being performable in a deposition cell separate from the reduction cell, or in the same cell.

This process uses a bath in which, after reduction, the salt formed is at a concentration higher than its solubility. Although this supersaturation is theoretically advisable, in practice, it leads to a decomposition of the salt or to a dismutation during which the titanium precipitates in such a way that sludge formationn occurs. This dismutation modifies both the salt bath concentration and the value of its mean valency, so that, as stated hereinbefore, a poor deposit may be obtained.

In addition, the mechanical displacement of the salt from the cathode requires difficulty usable mechanical means. Furthermore, the dispersion of the salt in the bath involves the use of powerful stirring means in order to obtain an appropriate homogeneity.

Finally, the deposition cell contains an anode where the halogen is given off in the vicinity of the deposition cathode and between these two electrodes is placed a diaphragm, which leads to the disadvantages referred to hereinbefore.

SUMMARY OF THE INVENTION

Confronted by all the problems arising from the prior art, the Applicant has attempted to overcome the difficulties resulting from composition variations and valency variations of the bath in the metal deposition zone by limiting the anodic electrochemical reduction in such a way as to avoid the formation of halogen and, consequently, the need for using a diaphragm. Under these conditions, a so-called electrodismutation occurs, i.e. the products of the reduction are both constituted by the base or basic metal in two different valency states, on the one hand, the metal of valency 0 and, on the other, a salt having a valency higher than that of the salt initially used. However, the problem then arises of the treatment of the higher valency salt which has formed and which must be recycled. This has led the Applicant to design an apparatus making it possible to carry out said electrodismutation, whilst continuously ensuring the reduction of the higher valency salt and its supply.

Thus, the present invention relates to an apparatus for continuously producing a polyvalent metal by the electrolysis of a halide of said metal dissolved in a bath of at least one melted salt, characterized in that it comprises:

an electrodismutation cell in whose bath are immersed at least one deposition cathode and at least two anodes connected to a current supply, which is at least partly of a continuous or d.c. nature, which develops, on the one hand, on the anodes a current density of a value below that which would give rise to the release of the halogen corresponding to that of the halide, but adequate for passing at least partly the metal of the halide to a higher valency state and, on the other hand, on the cathode a current density of a value giving rise to the deposition on said cathode of the metal of the halide;

a prereduction cell equipped with a halogen supply system, in whose bath are immersed at least one anode and a cathode separated from one another by a diaphragm and connected to a current source, which is at least partly continuous or in direct current form and where regulation takes place, on the one hand, of the cathode current density to a value below that for which the metal would be deposited on the cathode, but adequate for passing the said metal at least partly to a lower valency state and, on theother hand, the anode current density to a value giving rise to the release of halogen;

said cells being contiguous and their common wall formed by a grid electrically insulated from the walls of the cell and negatively polarized and which constitutes the cathode through which flows the bath by forced convection, in such a way as to produce a movement from the top to the bottom of the electrodismutation cell and from the bottom to the top in the prereduction cell.

DESCRIPTION OF THE PREFERRED EMBODIMENTS

Thus, the invention consists of producing the metal M by electrodismutation in a cell containing a solvent constituted by a bath of melted salts of a metal halide $MA_x$, which A represents the halogen and x the valency of the metal in the considered halide, which is lower than the value X of its maximum valency.

The following reactions occur during electrodismutation:

At the anode: $M^{x+} \rightarrow M^{(x+n)+} + ne^-$.

At the cathode: $M^{x+} + xe^- \rightarrow M^O$;

so that $(x+n)\ MA_x \rightarrow nM + xMA\ (x+n)$.

For example, in the case where the halide is titanium dichloride $TiCl_2$, we obtain:

At the anode: $Ti^{2+} \rightarrow Ti^{3+} + e^-$.

At the cathode: $Ti^{2+} + 2e^- \rightarrow Ti$;

so that $$3\ TiCl_2 \xrightarrow{2F} Ti + 2\ TiCl_3.$$

The halogen content $MA_x$ of the solvent is chosen in such a way that dissolving is complete, and consequently, there is no local variation which would give rise to the formation of sludge.

The electrodismutation conditions are obtained by regulating the anode current density, particularly in a range of values such that at the anode there is no giving off of halogen, but instead an increase in the valency of the metal.

Thus, under these conditions, a well crystallized, homogeneous metal deposit is obtained, which neither traps solvent, nor halide. Moreover, there is no risk of spontaneous dismutation of the halides and of the formation of sludge in the dismutation cell, because as a result of the very principle of the electrodismutation, the bath is always maintained in a concentration and valency state in thermodynamic equilibrium or slightly oxidized with respect to said equilibrium.

Preferably, in order to obtain optimum results, anode current densities below 0.2 $A/cm^2$ are used. Preferably, the quantity of metal given off is limited as a function of the concentration in the bath. This quantity does not exceed 25% and is more particularly between 1 and 10%. This makes it possible to more appropriately perform the electrolysis under industrial operating conditions. It is also preferable to stir the bath, e.g. using an inert gas, in order to homogenize it and ensure a circulation of the bath with respect to the electrodes.

It is obvious that when the appropriate metal quantity has been deposited on the cathode, if it is wished to continue the electrolysis operation, it is necessary to reduce the oxidized halide formed and to supply in the form of halide additional metal for compensating the quantity deposited, so that the initial concentration conditions are restored. This complement is introduced into the prereduction cell either in the form of halide where the metal is at the desired valency, or in the form of halide with a higher valency or even a maximum valency, because the latter will subsequently be reduced. However, it is also possible to introduce metal powder which, by chemical reaction with the oxidized halogen, can lead to the halide of the desired valency.

Therefore, the prereduction makes it possible to bring the metal of the halide oxidized during the production of the metal and possibly that of the halide complement or addition to the valency state existing in the cell prior to electrolysis, so as to maintain said state in equilibrium. Said reduction is performed electrolytically.

It is performed in a cell, in which are introduced at least one anode and one cathode, which are separated from one another by a diaphragm and connected to a current source, which is at least partly continuous or in direct current form and where, on the one hand, the cathode current density is regulated to a value below that for which metal would be deposited on the cathode, but adequate for passing at least part of said metal to a higher valency state and, on the other hand, the anode current density to a value giving rise to the release of halogen.

Thus, the prereduction consists of subjecting the oxidized halide MA (x+n) to a further electrolysis under conditions such that the initial halide $MA_x$ is again obtained. The following reactions occur during these operations:

At the anode: $A^- \rightarrow \frac{1}{2}A_2 + e^-$.

At the cathode: $M^{(x+n)} + n^e \rightarrow M^{x+}$;

thus, together $MA_{(x+n)} \rightarrow MA_x + n/2A_2$.

On using once again, the example of titanium, we obtain:

At the anode: $Cl^- \rightarrow \frac{1}{2}Cl_2 + e^-$.

At the cathode: $Ti^{3+} + e^- \rightarrow Ti^{2+}$;

so that in all: $TiCl_3 \rightarrow TiCl_2 + \frac{1}{2}Cl_2$.

It is obvious that the additional complement can also be provided by $TiCl_4$, in which case electrical conditions would be applied such that:

$$TiCl_4 \rightarrow TiCl_2 + Cl_2.$$

It is also pointed out that it is not necessary to transform the halide into $TiCl_2$, and that intermediate valency states between 2 and 3 or even below 2 can be reached without prejudicing the sought result.

These valency states are obtained by regulating, in particular, the cathode current density in a range of values, such that no metal forms, but so as still to be adequate in order to achieve the desired valency state. At this time, it is possible to add the halide complement in order to readjust the metal concentration of the bath, because the latter being appropriately reduced and not saturated spontaneously dissolves the halide introduced. Thus, the supply apparatus is of a simplified nature, which merely has simple means for contacting said halide with the bath and without any need for very powerful stirring.

Although the prereduction can only be performed in a cell where the electrodes are separated by a diaphragm, in order to avoid the recombination of the halogen with the halide reduced at the cathode, the performance of the electrolysis is then less critical than when the release of halogen has taken place in the vicinity of a deposition cathode, more or less marked valency variations in the bath not then having the same consequences as a reoxidation of the deposited metal.

Moreover, in the case of an unbalanced halide content and the formation of sludge during the reduction, it is easily possible to redissolve them by restoring equilibrium with a bath at a valency increased by dissolving the halide obtained from the deposition operation.

Electrolytic prereduction is preferably performed in a cell where the cathode density is below 0.5 $A/cm^2$ by dissolved metal molarity in order to avoid any metal formation. This cell is equipped with a device for supplying the halide complement and a diaphragm around the anode and the electrodes exposed to appropriate current densities.

In the apparatus according to the invention, the prereduction cell and the dismutation cell are arranged contiguously and have a common wall in the form of a grid through which the bath flows. This grid is electrically insulated from the cell walls and is negatively polarized so as to constitute the prereduction cathode.

This flow is produced by forced convection, which is carried out by means of neutral gas bubbling with respect to the halide bath, such as e.g. argon. This gas is introduced with the halogen complement, in such a way that the bath travels from top to bottom in the dismutation cell and from bottom to top in the prereduction cell with a speed parallel to the plane of the electrodes between 1 and 10 cm/sec., in which the halide concentration of the bath is maintained within limits favorable for a good quality deposit.

Thus, the production process becomes continuous and makes it possible to maintain the concentration and valency values within relatively narrow ranges.

The metal deposited on the cathode of the dismutation cell can be recovered at any time after interrupting the passage of current and when the cathode has been removed from the bath.

BRIEF DESCRIPTION OF THE DRAWINGS

The invention is illustrated by the attached drawings, in which.

Figure 1:
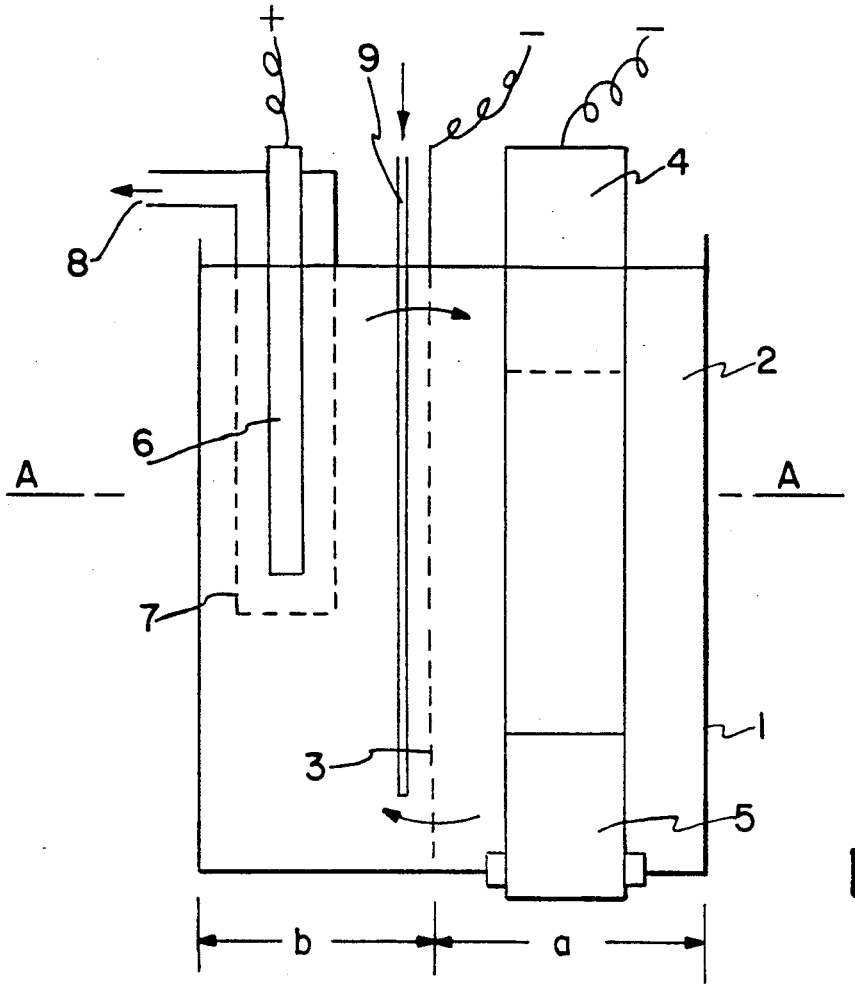
FIG. 1 is a sectional view along a vertical plane BB of an apparatus for producing metal with electrolytic prereduction formed from two contiguous cells and FIG. 2 is a sectional view along a horizontal plane AA of the same cell.
Figure 2:
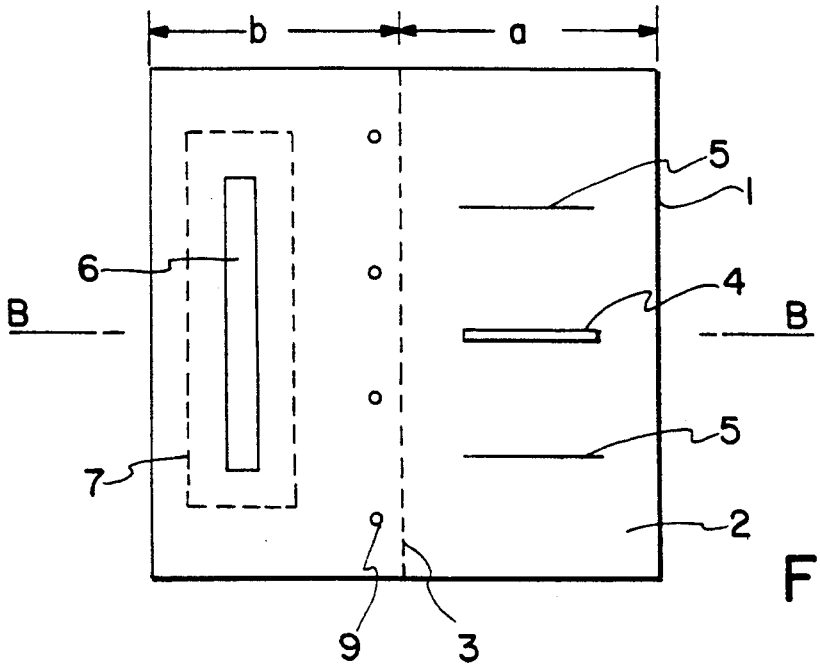

It is possible to see a container 1 filled with melted salt 2 and subdivided into two cells a and b by a grid 3, which is negatively polarized and electrically insulated from the container:

1. there is a dismutation cell in which are immersed a negatively charged deposition cathode 4, which projects above the bath and is extended to a certain distance from the bottom and two positively charged anodes 5 which are completely immersed, fixed via an electrical insulant to the bottom of the container and located on either side of the cathode. The presence of the two anodes is explained by the fact that it is necessary to have a low current density in order to avoid the release of halogen.

2. there is also a prereduction cell in which are partly immersed a positively charged anode 6, surrounded by a diaphragm 7 equipped with a halogen outlet 8 and tubes 9 for the supply of the halogen complement and argon. In said container, the bath flows in the bottom of the dismutation cell towards the prereduction cell and in the opposite direction at the top.

The container is generally made from polarized or unpolarized, bare stainless steel, which may, optionallly, be cooled in order to form an autolining or can internally be provided with a refractory coating.

The grid is made from an electricity conducting material and in particular metal. It is provided with salts and leaves a space with respect to the bottom and the bath level, so as to facilitate the outflow of the bath. The cathodes are made from steel, whilst the anodes and supply tubes are made from graphite. The metallic diaphragm is polarizable.

In operation, the metal is deposited on the cathode 4; whilst in the vicinity of the anodes 5, the halide oxidized to a higher valency state is entrained with the bath by forced convection with the argon in the downwards direction through the grid in the reduction cell, where additional halide and argon are introduced by tubes 9. The oxidized halide and the complement are reduced at the grid 3 and recycled to the deposition cell passing above the grid, whilst the halogen is given off on the anode surrounded by the diaphragm 7, which limits the oxidation reaction of the bath.

The invention will be better understood with the aid of the following application examples:

EXAMPLE 1

Use is made of an apparatus having two contiguous cells:

1. the dismutation cell has a height 740 mm, length 450 mm and width 300 mm and in it are placed vertically and in parallel to the major faces of the cell, a central cathode of width 200 mm, thickness 10 mm and height 500 mm, immersed to 250 mm from the bottom and two anodes on either side of the cathode and having a width of 250 mm, thickness of 10 mm and height of 550 mm, said electrodes being 50 mm from the anode.

2. the prereduction cell has the same dimensions and is contiguous with the dismutation cell by its small lateral face via a grid of width 300 mm and height 740 mm, which is electrically insulated from the cell walls and leaves passages in the bath at the top and bottom with a height of 25 mm. In said cell there is immersed, on the one hand, an anode positioned parallel to the small face of the cell, and in its center, which has a height of 660 mm, width of 150 mm and thickness of 20 mm surrounded at a distance of 25 mm by a conventional diaphragm, as well as, or the other hand, two supply tubes for a complement of halogen and argon wth an internal diameter of 5 mm and immersed over a height of 640 mm in the bath.

This container container approximately 150 kg of a melted salt bath constituted by sodium chloride at 800° to 850° C., in which were dissolved 5% by weight tianium chloride with a mean valency of 2.1, i.e. approximately 7.8 kg. Between the electrodes of the dismutation cell there passed was a direct current of 1000 Amperes, so as to create current densities on the anode of 0.18 A/cm$^2$ and on the cathode of 0.5 A/cm$^2$, whilst ensuring a circulation of the bath with the aid of an argon flow rate of 100 l/h, so as to have 5 r.p.m. towards the prereduction cell and in which also passed a current of 1000 A and where the current densities were 1 A/cm$^2$ on the anode and 0.2 A/cm$^2$ on the cathode.

Under the effect of the previously described electrochemical reactions and with a complement of fresh halide in the form of $TiCl_4$ at a rate of 3.245 kg/h, so as to compensate the deposited metal quantity, i.e. with an introduction efficiency of 95%, 0.780 kg/h of homogeneous, well crystallized titanium was deposited, which was free from halide and melted salt.

EXAMPLE 2

Two contiguous cells of identical dimensions to those described hereinbefore were used and which contained the same NaCl bath, but in which were dissolved 2% by weight of $NbCl_{3.2}$. Into the dismutation cell there was passed a current of 165 A, and use was made of a cathode of height 400 mm and width 100 mm, so as to have a cathode density of 0.2 A/cm$^2$, whilst the anode density was 0.06 A/cm$^2$.

In the prereduction cell there flowed a current of 95 A. The anode dimensions were height 200 mm, width 100 mm and thickness 20 mm, so as to allow an anode current density of 0.25 A/cm$^2$, the cathode density being 0.02 A/cm$^2$.

There were 2.5 bath rotations per hour, and the prereduction cell was supplied with $NbCl_5$ at a rate of 0.440 kg/h (introduction efficiency 95%).

The following electrochemical reactions occurred:

Dismutation cell:

At the cathode: $Nb^{3+}+3e^- \rightarrow Nb$.

At the anode: $Nb^{3+} \rightarrow Nb^{4+}+e^-$;

i.e. inn all $4NbCl_3 \rightarrow Nb+3NbCl_4$.

Prereduction cell:

At the anode: $Cl^- \rightarrow \frac{1}{2}Cl_2+e^-$.

At the cathode: $Nb^{5+}+2e^- \rightarrow Nb^{3+}$;

i.e. in all, $NbCl_5 \rightarrow NbCl_3+Cl_2$.

Thus, 137 g/h of niobium in the form of homogeneous crystals were recovered, which were not impregnated with salt or chloride and corresponding to a Faraday efficiency of 90%.

EXAMPLE 3

Use was made of two contiguous cells identical to those of Example 1. The bath was constituted by NaCl containing 2% by weight NaF and 5% by weight $ZrCl_{3.3}$ (i.e. $\frac{1}{3}$ of $ZrCl_4$ and $\frac{2}{3}$ of $ZrCl_3$).

A direct current of 275 A flowed in the dismutation cell, so as to have a cathode density of 0.33 A/cm$^2$ and anode density of 0.10 A/cm$^2$. A rate of 1.75 bath rotations per hour were ensured, and the prereduction cell was supplied at a rate of 0.75 kg/h of $ZrCl_4$.

The following electrochemical reactions took place in the cells:

Dismutation cell:

At the cathode: $Zr^{3+}+3e^- \rightarrow Zr$.

At the anode: $Zr^{3+} \rightarrow Zr^{4+}+e^-$;

i.e. in all, $4ZrCl_3 \rightarrow Zr+3ZrCl_4$.

Prereduction cell:

At the anode: $Cl^- \rightarrow \frac{1}{2}Cl_2+e^-$.

At the cathode: $Zr^{4+}+e^- \rightarrow Zr^{3+}$;

i.e. in all: $ZrCl_4 \rightarrow ZrCl_3+\frac{1}{2}Cl_2$.

Thus, 0.290 kg/h of homogeneous, well crystallized zirconium was recovered, which contained neither halide, nor bath.

EXAMPLE 4

Two contiguous cells identical to those of Example 1 were used. The bath was constituted by pure NaCl in which was dissolved $UCl_{3.3}$. The electrical and rotation conditions were the same as in Example 3, and the prereduction cell was supplied with $UCl_4$ at a rate of 1.270 kg/h.

The following electrochemical reactions took place in the cells:

Dismutation cell:

At the cathode: $U^{3+}+3e^- \rightarrow U$.

At the anode: $U^{3+} \rightarrow U^{4+}+e^-$;

i.e. in all, $4UCl_3 \rightarrow U+3UCl_4$.

Prereduction cell:

At the anode: $Cl^- \rightarrow \frac{1}{2}Cl_2+e^-$.

At the cathode: $U^{4+}+e^- \rightarrow U^{3+}$;

i.e. in all, $UCl_4 \rightarrow UCl_3+\frac{1}{2}Cl_2$.

Thus, 0.760 kg/h of homogeneous, crystallized uranium were recovered containing neither bath, nor chloride.

What is claimed is:

1. Apparatus for continuous production of a polyalent metal by electrolysis of a halide of the metal in bath of at least one molten salt, comprising:

a first, electrodismutation cell comprising a plurality of walls, at least one deposition cathode, at least two electrodismutation anodes, and means for supplying to said anodes and cathode an at least partly direct current having a density on the anodes which is less than that necessary to release halogen from the halide but sufficient for converting at least part of the metal of the halide to a higher valency, and having a density on the cathode which is sufficient to deposit the metal of the halide thereon;

a second, prereduction cell comprising a plurality of walls, means for supplying metal halide thereto, a prereduction anode, a prereduction cathode, a diaphragm therebetween, and means for supplying to said prereduction anode and prereduction cathode and at least partly direct current having a density on the prereduction cathode less than that necessary to deposit the metal of the halide thereon, but sufficient to convert at least a part of the metal to a lower valency, and having a density on the prereduction anode sufficient to release halogen from the metal halide;

said first and second cells being contiguous and having a common wall formed by a negatively polarized grid insulated from the walls of the cells, said grid serving as the prereduction cathode; and means to cause bath flow by forced convection through said grid to produce a top-to-bottom movement in the electrodismutation cell and a bottom-to-top movement in the prereduction cell.

2. Apparatus according to claim 1, wherein said means to cause bath flow comprises means for bubbling a gas associated with said means for supplying metal halide.

3. Method for continuous production of a polyvalent metal by electrolysis of a halide of the metal in a bath of at least one molten salt, comprising the steps of:

disposing a first electrodismutation cell contiguous with a second prereduction cell, and disposing between the cells a grid serving as a common wall which is insulated from other walls of the cells;

disposing in said first cell at least one deposition cathode and at least two electrodismutation anodes;

disposing in said second cell a prereduction anode and a diaphragm, which separates the prereduction anode from the grid;

supplying metal halide to said prereduction cell, and causing a flow of bath by forced convection from top-to-bottom in said electrodismutation cell and from bottom-to-top in said prereduction cell;

in said electrodismutation cell, passing and at least partly direct current between said deposition cathode and said electrodismutation anodes, said current having an anodic density insufficient to convert the halide to free halogen but sufficient to cause an increase in valency of at least a part of the metal, and a cathodic density sufficient to reduce the metal halide to free metal; and in said prereduction cell, passing an at least partly direct current between said prereduction anode and said grid serving as a cathode, said current having an anodic density sufficient to convert the halide to free halogen, and a cathodic density insufficient to deposit free metal, but sufficient to cause a decrease in the valency of at least part of the metal.

4. Method according to claim 3, wherein said bath flows by forced convection from top-to-bottom and from bottom-to-top at a speed between 1 and 10 cm/sec.

* * * * *